US011229938B2

(12) United States Patent
Del Fabro

(10) Patent No.: US 11,229,938 B2
(45) Date of Patent: Jan. 25, 2022

(54) COMBINED MACHINE FOR WORKING WIRE ROD AND CORRESPONDING WORKING METHOD

(71) Applicant: M.E.P. Macchine Elettroniche Piegatrici S.p.A., Reana del Rojale (IT)

(72) Inventor: Giorgio Del Fabro, Udine (IT)

(73) Assignee: M.E.P. Macchine Eletrroniche Piegatrici, S.p.A., Reana del Rojale (IT)

( * ) Notice: Subject to any disclaimer, the term of this patent is extended or adjusted under 35 U.S.C. 154(b) by 159 days.

(21) Appl. No.: 15/756,038

(22) PCT Filed: Aug. 25, 2016

(86) PCT No.: PCT/IB2016/055072

§ 371 (c)(1),
(2) Date: Feb. 27, 2018

(87) PCT Pub. No.: WO2017/033145

PCT Pub. Date: Mar. 2, 2017

(65) Prior Publication Data

US 2018/0221930 A1 Aug. 9, 2018

(30) Foreign Application Priority Data

Aug. 27, 2015 (IT) ..... 102015000046859

(51) Int. Cl.
*B21D 7/022* (2006.01)
*B21F 1/00* (2006.01)
*B21D 11/12* (2006.01)

(52) U.S. Cl.
CPC ..... *B21D 7/022* (2013.01); *B21D 11/12* (2013.01); *B21F 1/00* (2013.01); *B21F 1/006* (2013.01)

(58) Field of Classification Search
CPC . B21D 7/022; B21D 11/12; B21F 1/00; B21F 1/006; B21F 35/00; B21F 23/007
(Continued)

(56) References Cited

U.S. PATENT DOCUMENTS 4,471,819 A * 9/1984 Nihashi ..... B21F 1/00 140/71 R
4,662,204 A * 5/1987 Saegusa ..... B21D 7/022 269/234

(Continued)

FOREIGN PATENT DOCUMENTS

AU 778830 B2 * 12/2004 ..... B21D 7/12
EP 0 427 038 A1 5/1991

(Continued)

OTHER PUBLICATIONS

International Search Report and Written Opinion from corresponding International Application No. PCT/IB2016/055072 dated Jan. 12, 2016; (8 pp).

*Primary Examiner* — Jimmy T Nguyen
*Assistant Examiner* — Mohammed S. Alawadi
(74) *Attorney, Agent, or Firm* — Calderone Bullock LLC

(57) ABSTRACT

A combined machine for working a wire rod in order to obtain metal products with at least a curved shape is disclosed that comprises a support bench configured to support and guide, along an axis of movement, a mobile slider comprising a work plane on which a curving unit is operative. The combined machine has vise means in the support bench. The slider also comprises, on the work plane, a bending unit associated with the curving unit and the vise means are positionable in a direction orthogonal to the axis of movement.

12 Claims, 3 Drawing Sheets

(58) Field of Classification Search
USPC ..... 72/169, 307
See application file for complete search history.

(56) References Cited

U.S. PATENT DOCUMENTS

| | | | | | |
|---|---|---|---|---|---|
| 4,805,436 | A * | 2/1989 | Saegusa | B21D 7/022 | 72/306 |
| 5,765,426 | A * | 6/1998 | Saegusa | B21D 7/08 | 72/306 |
| 5,873,278 | A * | 2/1999 | Saegusa | B21D 7/12 | 72/306 |
| 6,167,740 | B1 * | 1/2001 | Lipari | B21D 7/00 | 72/306 |
| 7,891,225 | B2 * | 2/2011 | Hammerer | B21D 7/12 | 72/299 |
| 8,359,896 | B2 * | 1/2013 | Wolf | B21D 7/022 | 72/149 |
| 2017/0348759 | A1 * | 12/2017 | Furuse | B21F 35/00 | |

FOREIGN PATENT DOCUMENTS

| | | | | |
|---|---|---|---|---|
| EP | 0 850 707 | A1 | 7/1998 | |
| EP | 1468756 | B1 * | 7/2006 | B21D 7/08 |
| JP | 2003-117612 | A | 4/2003 | |
| JP | 2006-315047 | A | 11/2006 | |

* cited by examiner

COMBINED MACHINE FOR WORKING WIRE ROD AND CORRESPONDING WORKING METHOD

BACKGROUND OF THE INVENTION

Field of the Invention

The present invention concerns a combined machine for working wire rod, and also the corresponding method for working wire rod, advantageously in long bars.

The combined machine and corresponding method are used to obtain metal products, starting from normal wire rod, for example but not restrictively for the building trade.

Such products, at the end of working, have at least a curved conformation with a desired continuous and/or variable radius of curvature.

The wire rod can have a round, square, rectangular or other cross section shape.

Description of Related Art

Machines are known, for curving one or more wire rods simultaneously to obtain long metal products.

Known curving machines are provided by way of example with a support bench, along which two sliders run in a controlled and desired manner depending on the desired result.

Each of the two sliders comprises a curving unit, or calendering unit, configured to deform, in particular to curve, the wire rod, adjustable according to the production requirements associated with the finished product to be obtained.

Generally, each curving unit comprises contrast rolls also possibly able to draw the wire rod, and a mobile curving roll able to impose on the wire rod the desired deformation that is then stabilized in the desired curve.

It is also known to provide a clamping device on the support bench, for example a vise interposed between the two sliders, to clamp the wire rod to be curved, allowing different types of operations.

One disadvantage of known curving machines is that they are not able to also effect bending operations on the wire rod.

This is particularly disadvantageous if the finished product needs one or more bends to be made before and/or after and/or during calendering.

Currently, to perform the bending operation, appropriate machines are needed, which are made to intervene before or after calendering. This entails disadvantages both in economic terms, in terms of quality and of time, maintenance, programming, storage of spare parts and energy consumption and spaces occupied.

Another disadvantage of known curving machines is that they require the direct intervention of an operator, also while the work is being carried out, to accompany and/or support the product being worked. This causes problems of safety for the operators and possible accidents.

There is therefore a need to perfect a combined machine for working wire rod, and a corresponding method, which can overcome at least one of the disadvantages of the state of the art.

BRIEF SUMMARY OF THE INVENTION

In particular, one purpose of the present invention is to obtain a curving machine that can carry out independently not only the curving operations but also bending operations on the wire rod, all in a coordinated and desired manner.

Another purpose of the present invention is to obtain a compact curving machine, at a lower cost than the two single machines, which allows to save energy and to improve the times and costs of obtaining the finished product.

Another purpose of the present invention is to obtain a general energy saving and to save spaces occupied, maintenance costs and programming costs and all that is connected thereto.

Another purpose of the present invention is to obtain a combined machine that is extremely safe for the operators and that can function autonomously without a direct intervention of the operators.

The present invention is set forth and characterized in the independent claims, while the dependent claims describe other characteristics of the invention or variants to the main inventive idea.

Embodiments described here concern a combined machine, known in its previous formulation, comprising a support bench configured to support and guide at least one slider mobile in a controlled and desired manner along a longitudinal axis of movement. The mobile slider comprises a work plane on which at least one curving unit is operative.

The support bench also comprises vise means. The vise means are configured to clamp the wire rods on instructions.

According to the present invention, the at least one mobile slider also comprises, on the work plane, a bending unit associated with the at least one curving unit.

According to another aspect of the present invention, at least the vise means on the support bench are positionable orthogonally to the longitudinal axis of movement of the support bench.

The combined machine is therefore configured to curve and/or bend a wire rod into the desired shape, in other words the combined machine according to the present invention comprises, in at least one slider, both the curving unit and also the bending unit, the combined machine being equipped with, or able to be equipped with, a programmable control, command and management unit of the combined machine.

According to a variant, at least two mobile sliders are provided.

According to another variant, the vise means are interposed between the mobile sliders.

According to another aspect of the present invention, one or both the mobile sliders are equipped with respective vise means, mobile and positionable in an orthogonal direction to the longitudinal axis of the support bench.

Advantageously, the vise means can be located on the respective mobile slider in a front position with respect to the other slider.

According to another aspect of the present invention, the curving units and/or the bending units, present on the respective mobile slider, are positionable retractable with respect to the work plane of the mobile slider, depending on the specific operation.

According to a variant, only a part of one or both the curving and/or bending units are retractable.

These aspects advantageously allow to use the machine for any type of curving and/or bending operation, preventing interference between the units, at the same time allowing the correct positioning and control of the wire rod and the correct functioning of the whole machine.

Moreover, a configuration of combined machine as described above allows to completely automate the operations performed on the wire rod and thus to avoid the intervention of operators while the machine is working. This allows to obtain a combined machine which is extremely safe for the operators and therefore to prevent accidents.

According to a possible variant, the machine provides in every mobile slider a single drive means configured to drive, simultaneously or sequentially, the functioning of either the curving unit or the bending unit.

This aspect is particularly advantageous since it substantially allows to halve the drive means and the costs of production, spare parts and management.

The various aspects and characteristics described in the present description can be applied individually where possible. These individual aspects, for example aspects and characteristics described in the description or in the attached dependent claims, can be the object of divisional applications.

It is understood that any aspect or characteristic that is discovered, during the patenting process, to be already known, shall not be claimed and shall be the object of a disclaimer.

BRIEF DESCRIPTION OF THE SEVERAL VIEWS OF THE DRAWINGS

These and other characteristics of the present invention will become apparent from the following description of some embodiments, given as a non-restrictive example with reference to the attached drawings wherein.

DETAILED DESCRIPTION OF THE INVENTION

Figure 1:
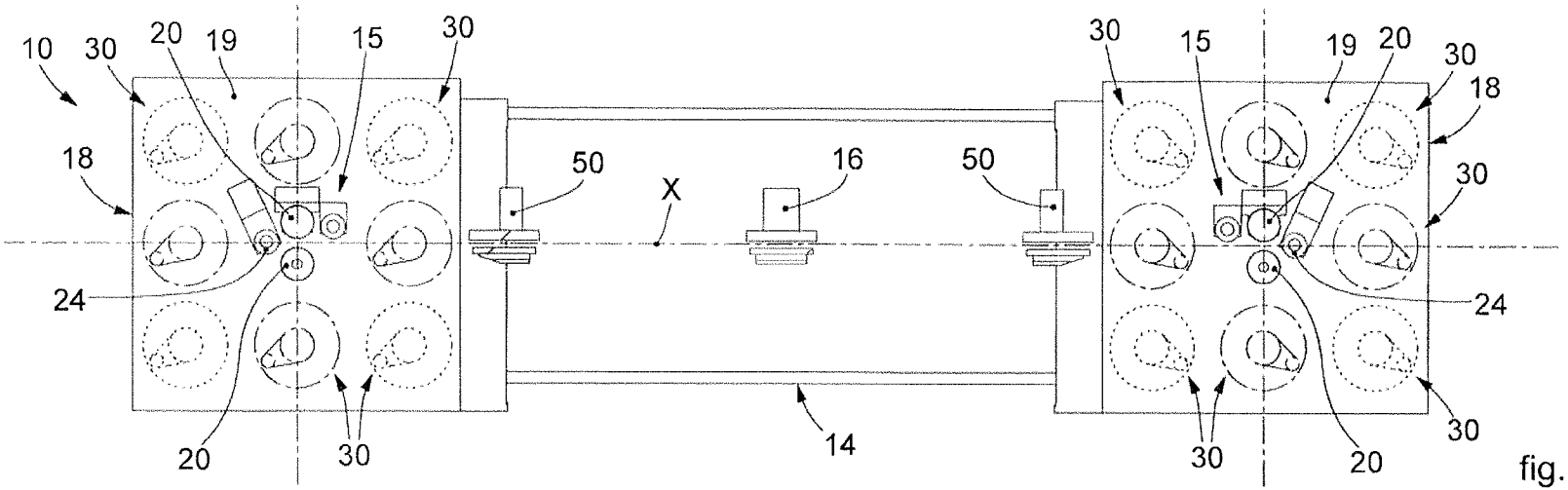
FIG. 1 shows schematically a combined machine according to the present invention.
Figure 2:
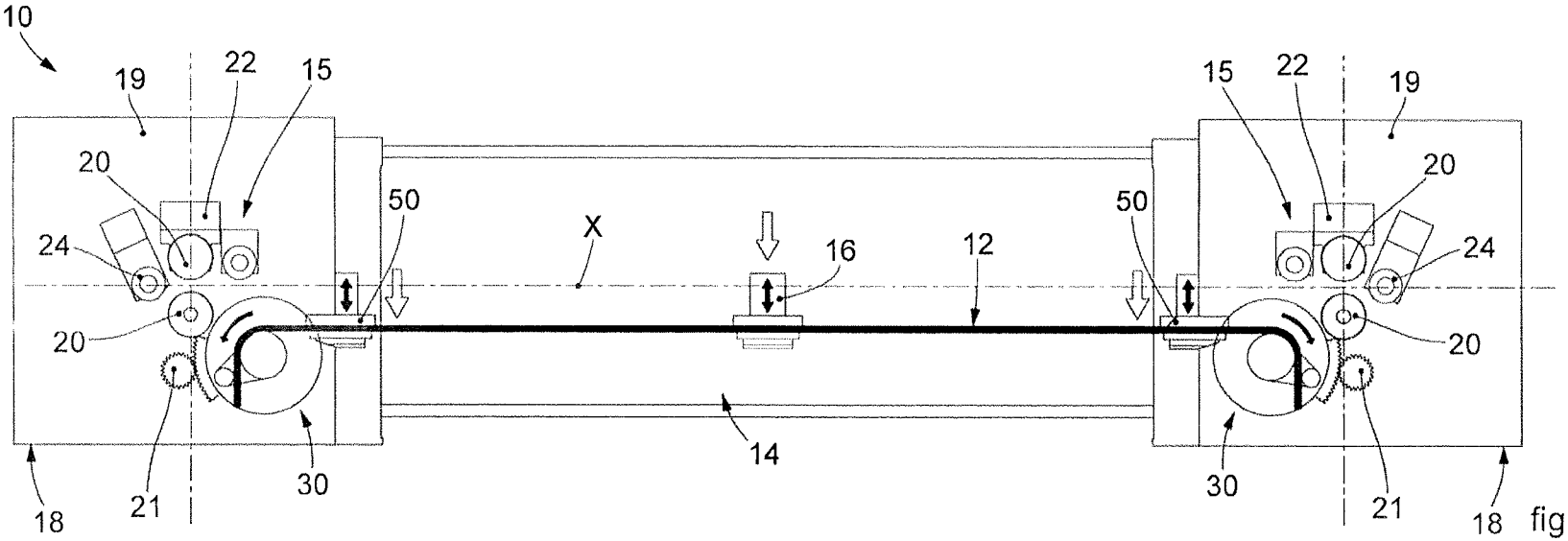
FIG. 2 shows a combined machine, according to the present invention.

To facilitate comprehension, the same reference numbers have been used, where possible, to identify identical common elements in the drawings. It is understood that elements and characteristics of one embodiment can conveniently be incorporated into other embodiments without further clarifications.

We shall now refer in detail to the various embodiments of the present invention, of which one or more examples are shown in the attached drawing. Each example is supplied by way of illustration of the invention and shall not be understood as a limitation thereof. For example, the characteristics shown or described insomuch as they are part of one embodiment can be adopted on, or in association with, other embodiments to produce another embodiment. It is understood that the present invention shall include all such modifications and variants.

Before describing these embodiments, we must also clarify that the present description is not limited in its application to details of the construction and disposition of the components as described in the following description using the attached drawings. The present description can provide other embodiments and can be obtained or executed in various other ways. We must also clarify that the phraseology and terminology used here is for the purposes of description only, and cannot be considered as limitative.

According to the present invention, FIG. 1 is used to describe embodiments of a combined machine 10 configured to work wire rods 12 into one or more long metal products, the wire rods having different characterizations and nominal sizes. In particular, the wire rods 12 can be any type and shape in long bars, and are worked by the combined machine 10 to obtain metal products with at least a curved shape.

Here and hereafter in the description we will refer to working a single wire rod 12, but it is clear that the combined machine 10 can work several wire rods 12 simultaneously.

The combined machine 10 comprises a support bench 14 and one or more mobile sliders 18. The support bench 14 is configured to support and guide one or more mobile sliders 18 along a longitudinal axis of movement X of the support bench 14. Hereafter, we will describe by way of example the case where two sliders 18 are provided, reciprocally mobile toward/away from the axis of movement X.

The combined machine 10 also comprises a vise means or clamping means 16. The vise means 16 is provided on the support bench 14, for example in a median position, and is positionable orthogonal to the longitudinal axis of movement X of the support bench 14, according to requirements.

According to a possible solution, the vise means is movable and positionable in a direction orthogonal to the axis of movement X that lies on a plane parallel to the lying plane of the support bench 14, so as to keep the wire rod or rods 12 on the support benches 14.

Although not shown, the combined machine 10 can be associated with a programmable control, management and command unit, configured to control, manage and command at least the functioning of the one or more sliders 18.

The support bench 14 can be located substantially horizontal or sub-horizontal, although a vertical orientation is not excluded.

The sliders 18 are mobile on the support bench 14 in a desired and controlled manner, each slider 18 being managed in itself or in relation to the other slider 18 and/or vise means 16 depending on the operations under way.

In particular, the sliders 18 are mobile along the axis of movement X in an independent and controlled manner.

According to the present invention, each slider 18 comprises a work plane 19 and at least a curving unit 15. The curving unit 15 operates on the work plane 19. The curving unit 15, of a known type, is configured to curve the wire rods 12 in a desired manner.

In particular, by curving here and hereafter in the description, we mean that the wire rod 12 is subjected to a continuous deformation for an extended longitudinal portion of the length of the wire rod 12, for example for at least 20 cm or for the entire length. In this case, the deformation of the curving unit 15 occurs substantially continuously for the whole length of the longitudinal portion affected by the curving. In fact, during the curving operations the curving unit 15 is not only driven to deform the wire rod 12 but is also moved in a direction parallel to the axis of movement X, so as to affect the whole longitudinal development of the curved longitudinal portion.

According to embodiments described here, each slider 18 comprises, on the work plane 19, a bending unit 30, also of a known type, associated with the at least one curving unit 15.

In particular, by bending, here and hereafter in the description, we mean that the wire rod 12 is subjected to a localized deformation only in the zone where the bending unit 30 acts, for example in correspondence with an abutment element of the latter. When the bending unit 30 is driven, there is no translation thereof in a direction parallel to the axis of movement X.

Moreover, coordinated with the work plane 19, each slider 18 comprises its own vise means or transport means 50, associated with the curving unit 15 and positionable orthogonal to the axis of movement X.

In particular, in the embodiments which provide two of the sliders 18, on each slider 18 there is a respective vise means 50 located in a position connected to the vise means 16 present on the support bench 14 and the vise means 50 is positionable orthogonal to the axis of movement X.

According to some embodiments, the vise means 50 is positionable orthogonal to the axis of movement X and lies on the work plane 19.

According to some solutions, the vise means 16 and the vise means 50 are located or positionable in an aligned position with respect to each other, for example in a direction parallel to the axis of movement X.

The bending unit 30, for example described with reference to FIG. 1, can be positioned in any position with respect to the support bench 14 of the slider 18.

According to a variant embodiment of the present invention, the two sliders 18 can have the bending units 30 not specular with respect to each other.

According to some embodiments of the present invention, the bending unit 30 can be positioned on the axis of movement X.

According to other embodiments of the present invention, the bending unit 30 can be positioned outside the axis of movement X.

In the embodiments described using FIGS. 2 to 5, the bending unit 30 is positioned in a preferential position. In particular, the curving unit 15 is positioned centrally to the work plane 19, although the possibility of a different position is not excluded, while the bending unit 30 is located in a laterally offset position, in a direction orthogonal to the axis of movement X, with respect to the curving unit 15. Said position is coordinated with that of the bending unit 30 so as to facilitate the operations and to prevent useless interferences.

As indicated, the drive of the curving unit 15 and the bending unit 30 can be independent.

According to an advantageous variant embodiment, at least one slider 18 provides a single drive means configured to drive the functioning, simultaneously or sequentially, both of the curving unit 15 and also of the bending unit 30. For example, with reference to embodiments described using FIGS. 2-5, and combinable with all the embodiments described here, a single drive means can be provided, comprising a motor member 21, which drives the bending unit 30 and the latter in turn is kinematically connected to the curving unit 15, causing the latter also to be driven.

According to a possible solution, the motor member 21 is provided with a pinion that engages on a toothed crown associated with the bending unit 30, for example a bending disc of the latter.

A driven toothed wheel is in turn engaged on the toothed crown, installed integrated with a rotary component of the curving unit 15.

Merely by way of example, it is provided that the driven toothed wheel is installed integrated and coaxial with a motor and/or contrast roll of the curving unit 15.

According to some embodiments of the present invention, at least some of the curving units 15 and/or bending units 30 can be positioned hidden with respect to the work plane 19 of the respective slider 18.

The vise means 16 and 50 respectively provided on the support bench 14 and on the sliders 18 can also be advantageously hidden with respect to the work plane 19 defined by the sliders 18.

In particular, the curving units 15 and/or the bending units 30, like the vise means 16, 50, can be moved between a position protruding from the work plane 19, in which they can act on the wire rod 12, and a retracted position, or "hidden" as indicated above, in which the work plane 19 is defined and there is no interference with the wire rod 12.

Each slider 18 can be moved, in a desired and autonomous manner, by drive units in relation to the operations under way, or can be moved by the drawing action that the curving units 15 exert on the wire rod 12. In this latter case, it can be advantageous that the vise means 16 clamps the wire rod 12.

According to a possible solution, the machine 10 comprises movement members associated with the sliders 18 to allow the desired and controlled movement of the latter with respect to the support bench 14.

The movement members, not shown in the drawings, can comprise worm screw mechanisms, racks, chains or similar or equivalent movement members.

According to some embodiments, the curving units 15 comprise two contrast rolls 20 located in an opposite position from each other, at least one contrast roll 20 advantageously being provided with positioning means 22 configured to allow a selective movement toward/away from the other contrast roll 20 to adjust the gap between them in relation to the wire rod 12.

The pressure that the contrast rolls 20 exert in a desired manner on the wire rod 12 can be finalized for drawing the wire rod 12, or an action to clamp the wire rod 12.

In a known manner, at least one of the contrast rolls 20 can be motorized either to draw the wire rod 12, in which case it can also draw the respective slider 18, or to coordinate with the other contrast roll 20.

The curving units 15 can work in a known manner.

By way of example, the curving units 15 also comprise a curving roll 24 positionable with respect to the contrast rolls 20 and configured to exert a desired deformation on the wire rod 12.

The position of the curving roll 24 with respect to the contrast rolls 20 determines the curvature of the wire rod 12.

The positioning angle of the curving roll 24 with respect to the contrast rolls 20 can be fixed or adjustable according to the desired curvature.

As described above, according to the present invention, the combined machine 10 comprises, in at least one slider 18, for example in both sliders 18, at least a bending unit 30 configured to bend the wire rod 12 in the desired manner.

In particular, the bending unit 30 is configured to bend at least one end of the wire rod 12 to perform head and/or tail bending operations.

According to the present invention, the bending unit 30 can intervene on one or both the heads of the wire rod 12.

According to a variant embodiment of the present invention, the bending unit 30 can also intervene in an intermediate position of the wire rod 12.

If the bending unit 30 intervenes in an intermediate position of the wire rod 12, it can intervene after at least one curved part has been obtained, or before the curving action has started.

According to the present invention, the bending unit 30 can be of any known type.

Merely by way of example, the bending unit 30 can be the type shown in the drawings, i.e., provided with a central contrast pin and a bending pin rotable peripherally to the contrast pin, to bend the wire rod that is positioned between the contrast pin and the bending pin. According to a possible variant, the bending unit 30 can comprise a hoe-shaped pin instead of the central contrast pin.

According to the present invention, the combined machine 10 can comprise abutment means, cooperating with the bending units 30.

In particular, the abutment means are configured to prevent unwanted deformations, that is, unwanted flexions or curves, in the wire rod 12 during the head and/or tail bending operations.

The abutment means can comprise or consist of at least one of the two vise means 50 present on the respective sliders 18.

It is understood that the geometric configuration shown in the attached drawings is not restrictive of the field of the present invention, since other positioning configurations of the various components of the combined machine 10 can be provided.

Once the operations of curving the wire rod 12 are concluded, the vise means 50 transport the wire rod 12 from the curving units 15 to the bending units 30 for subsequent bending operations.

According to one embodiment, the vise means 50 can also function as further abutment means used to prevent deformations, that is, unwanted flexions or curves, of the wire rod 12 during curving and/or bending.

According to a variant embodiment, the vise means 16 on the support bench 14 and the vise means 50 of the sliders 18 can cooperate to transport the wire rod 12 from the curving units 15 to the bending units 30 or vice versa, to perform the curving and bending operations on the wire rod 12.

According to the present invention, a possible method obtainable with the combined machine 10 according to the invention is now described.

In an initial condition of the machine 10, the method provides for example that the curving units 15, the bending units 30, the vise means 16 and the vise means 50 are positioned retracted with respect to the respective sliders 18 and the support bench 14.

According to the present invention, the method provides a step of feeding the wire rod, not shown in the attached drawings, during which the wire rod 12 to be worked is made available on at least one slider 18 mobile along the support bench 14.

Figure 4:
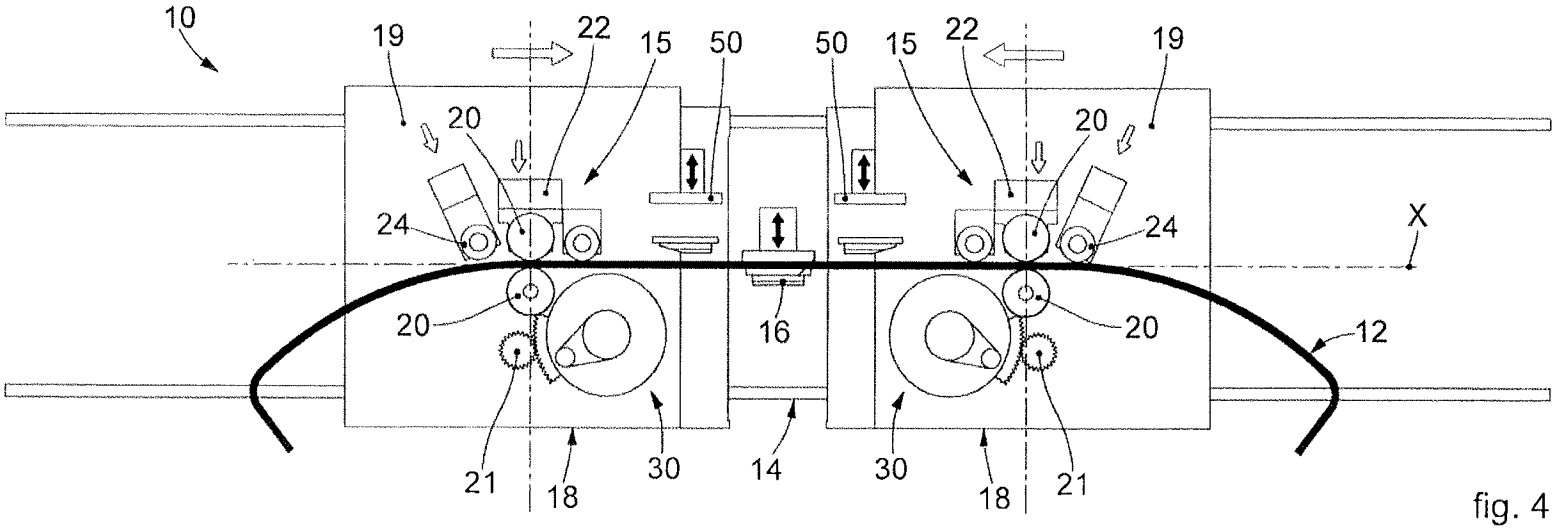
FIG. 4 shows a combined machine during another working step, according to the present invention.

According to the present invention, the method provides a curving step, shown in FIG. 4, during which the wire rod 12 is curved by at least one slider 18.

During this step, the bending units 30 and the vise means 50 can be positioned retracted so as not to interfere with the curving units 15 and to allow to make desired and determinate deformations on the wire rod 12.

During the curving step, the vise means 16 keep the wire rod 12 clamped until the two sliders 18 are near the vise means 16 themselves.

Figure 5:
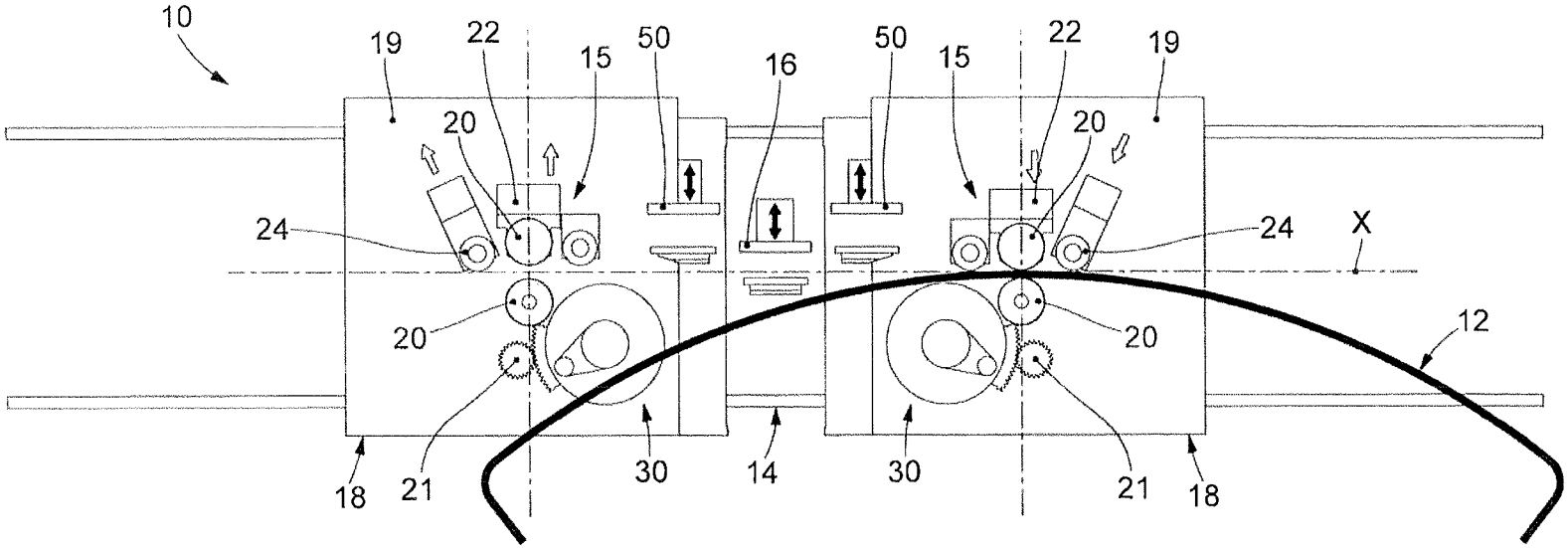
FIG. 5 shows a combined machine during another working step, according to the present invention.

According to a possible embodiment, during the curving step, as shown in FIG. 5, it is possible to provide that only one of the curving units 15 is functioning, with the other curving unit 15 positioned retracted. In particular, one of the two curving units 15 can complete individually the curving operations on the wire rod 12, to complete it.

The method according to embodiments described here also provides at least one bending step, during which at least part of the wire rod 12 is subjected to at least one bending. For example, during this step, at least one end of the wire rod 12 is bent in a desired manner.

Figure 3:
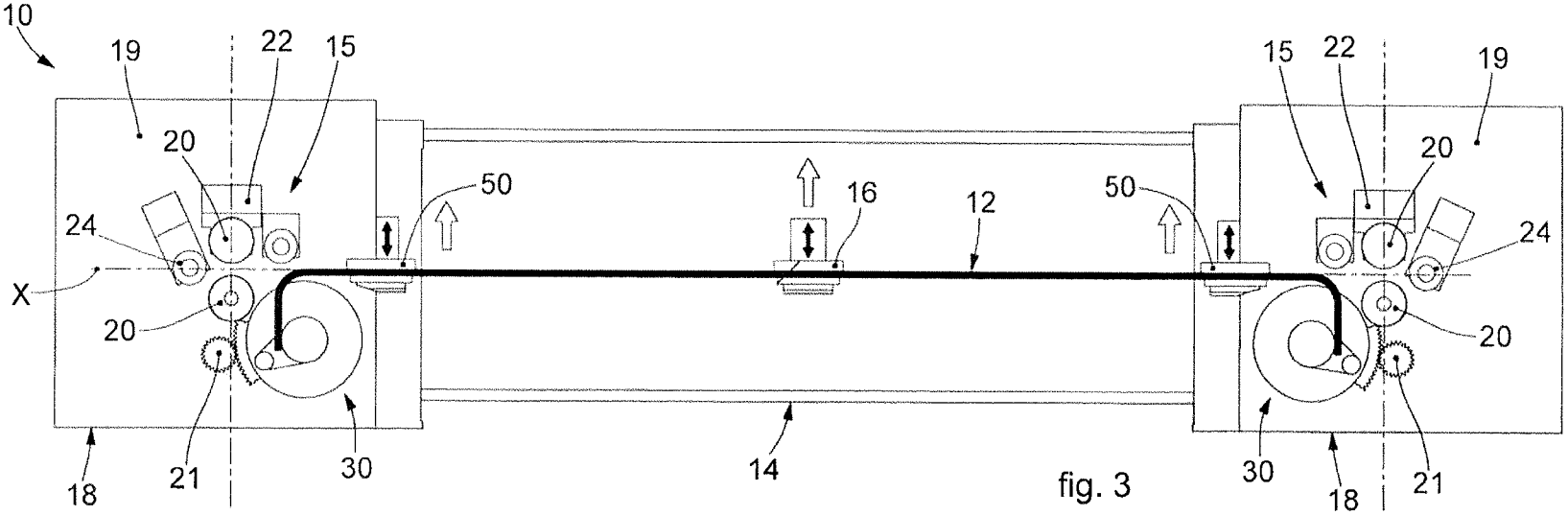
FIG. 3 shows a combined machine during a working step, according to the present invention.

Furthermore, the method provides at least a transport step, shown in FIG. 3, coordinated with the curving step and/or the bending step, during which the vise means 16 and/or the vise means 50 transport the wire rod 12 in cooperation with the curving units 15 or with the bending units 30, depending on the operation just performed on the wire rod 12.

In particular, once the necessary bending and curving operations have been concluded, the vise means 50 can function as expulsion elements, to expel the wire rod 12 worked, freeing the support bench 14 for the subsequent working of more wire rods 12. In particular, at the end of these operations, the machine 10 is reset to the initial condition, with the curving units 15, the bending units 30, the vise means 16 and the vise means 50 positioned retracted with respect to the work plane 19 associated with the sliders 18, which is therefore restored.

It is clear that modifications and/or additions of parts may be made to the combined machine 10 and the corresponding method as described heretofore, without departing from the field and scope of the present invention.

It is also clear that, although the present invention has been described with reference to some specific examples, a person of skill in the art shall certainly be able to achieve many other equivalent forms of combined machine 10 and corresponding method, having the characteristics as set forth in the claims and hence all coming within the field of protection defined thereby.

In the following claims, the sole purpose of the references in brackets is to facilitate reading: they must not be considered as restrictive factors with regard to the field of protection claimed in the specific claims.

I claim:

1. A combined machine for working a wire rod, in order to obtain metal products with a curved shape, the combined machine comprising a support bench, at least one mobile slider supported and guided by said support bench along an axis of movement, at least one curving unit operative on a work plane, wherein the curving unit comprises at least a curving roll and a contrast roll for curving the wire rod, said combined machine having a first vise means in the support bench, wherein the at least one slider also comprises, on the work plane, a bending unit, wherein the bending unit is provided with a central contrast pin and a bending pin rotatable peripherally to the contrast pin, said first vise means is movable in a direction orthogonal to the axis of movement;

wherein the bending unit is configured to subject the wire rod to a localized deformation in a zone where the bending unit acts directly on the wire rod; and wherein the curving unit is configured to subject the wire rod to a continuous deformation for an extended longitudinal portion of a length of the wire rod.

2. The combined machine as in claim 1, wherein said at least one slider comprises, coordinated with the work plane, respective second vise means positionable orthogonally to the axis of movement.

3. The combined machine as in claim 1, wherein there are two of said at least one slider and the combined machine further comprises a second vise means being present on each of the two sliders and located in a position connected to the first vise means present on the support bench, said second vise means on each of said two sliders being positionable orthogonally to the axis of movement.

4. The combined machine as in claim 1, wherein at least a part of said curving units and/or bending units is retractable with respect to said work plane of the respective slider.

5. The combined machine as in claim 3, wherein said two sliders are mobile along an axis of movement in an independent and controlled manner with respect to each other.

6. The combined machine as in claim 1, wherein one or more of said at least one slider, the bending unit, and the curving unit of the machine is operatively in communication with a programmable control, management and command unit.

7. The combined machine as in claim 1, wherein at least one bending unit of said at least one slider is positioned aligned to the axis of movement.

8. The combined machine as in claim 1, wherein at least one bending unit of said at least one slider is positioned misaligned to the axis of movement.

9. The combined machine as in claim 1, wherein said at least one slider provides a single drive means for driving both the functioning of said at least one curving unit and of said bending unit.

10. The combined machine as in claim 2, wherein said second vise means work as abutment means to prevent unwanted deformations in said wire rod.

11. A method with a combined machine as in claim 1, comprising feeding the wire rod so that said wire rod is made available on at least one of said at least one slider which is mobile along said support bench, curving said wire rod on at least one of said at least one slider;

bending said wire rod; and transporting said wire rod by said first vise means and/or a second vise means in cooperation with either or both of said at least one curving unit and said bending unit of said at least one slider and coordinated with either or both of the curving and bending of the wire.

12. A combined machine for working a wire rod, in order to obtain metal products with a curved shape, the combined machine comprising a support bench, at least one mobile slider supported and guided by said support bench along an axis of movement, a first vise means in the support bench, said first vise means movable in a direction orthogonal to the axis of movement, at least one curving unit operative on a work plane, wherein the curving unit comprises at least a curving roll and a contrast roll for curving the wire rod, wherein the at least one slider also comprises, (i) on the work plane, a bending unit, wherein the bending unit is provided with a central contrast pin and a bending pin rotatable peripherally to the contrast pin, and (ii) coordinated with the work plane, respective second vise means positionable orthogonally to the axis of movement; and wherein the bending unit is configured to subject the wire rod to a localized deformation in a zone where the bending unit acts directly on the wire rod; and wherein the curving unit is configured to subject the wire rod to a continuous deformation for an extended longitudinal portion of a length of the wire rod.

* * * * *